US009889666B2

(12) United States Patent
Abe et al.

(10) Patent No.: US 9,889,666 B2
(45) Date of Patent: Feb. 13, 2018

(54) LIQUID DISCHARGE APPARATUS

(71) Applicant: Seiko Epson Corporation, Tokyo (JP)

(72) Inventors: Takahiro Abe, Shiojiri (JP); Takao Yamamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/284,217

(22) Filed: Oct. 3, 2016

(65) Prior Publication Data

US 2017/0106654 A1 Apr. 20, 2017

(30) Foreign Application Priority Data

Oct. 14, 2015 (JP) ..... 2015-203050

(51) Int. Cl.
*B41J 2/165* (2006.01)

(52) U.S. Cl.
CPC ..... *B41J 2/16505* (2013.01); *B41J 2/1652* (2013.01); *B41J 2/16508* (2013.01); *B41J 2/16526* (2013.01); *B41J 2002/16502* (2013.01); *B41J 2002/16573* (2013.01)

(58) Field of Classification Search
CPC ..... B41J 2/16526; B41J 2002/16573; B41J 2/16505
See application file for complete search history.

(56) References Cited

U.S. PATENT DOCUMENTS

2014/0092153 A1 4/2014 Kikkawa et al.
2015/0085013 A1* 3/2015 Ito ..... B41J 2/16505 347/29

FOREIGN PATENT DOCUMENTS

JP 2014-069539 A 4/2014

* cited by examiner

*Primary Examiner* — Julian Huffman
(74) *Attorney, Agent, or Firm* — Workman Nydegger

(57) ABSTRACT

After the control section of a printer (liquid discharge apparatus) discharges ink on the basis of a print job, the control section waits for an input of the next print job while causing the discharge section to perform flushing. If the next print job is input before the elapsed time Te from the end of the ink discharge on the basis of the print job exceeds the waiting time Tw, the control section causes ink to be discharged on the basis of the next print job. On the other hand, if the next print job is not input before the elapsed time Te exceeds the waiting time Tw, the control section causes the cap to be subjected to capping.

12 Claims, 10 Drawing Sheets

LIQUID DISCHARGE APPARATUS

BACKGROUND

1. Technical Field

The present invention relates to a liquid discharge apparatus, such as an ink jet printer, and the like.

2. Related Art

To date, a printer that discharges ink, as an example of a liquid, from a nozzle formed on a liquid discharge section (recording head) onto a medium, such as paper, or the like so as to perform printing on the medium is known. Among printers of this type, there are printers provided with a cap for carrying out capping that changes an opening space of the nozzle of the liquid discharge section to a closed space (for example, JP-A-2014-69539).

In such a printer, capping the liquid discharge section is carried out so that a solvent component in the ink in the liquid discharge section is prevented from evaporating through the nozzle when printing is not performed.

Incidentally, in a printer such as that described above, the capping of the liquid discharge section is carried out with the termination of printing based on a print job, and thus if the next print job is input, it becomes necessary to, for example, release the capping of the liquid discharge section or to confirm whether or not an ink discharge defect has occurred before printing based on the next print job is started. That is to say, even if the next print job is input, it is not possible to start printing based on the next print job early, and thus the print efficiency (throughput) might deteriorate.

In this regard, the above-described circumstances are not limited to printers, but are generally common to liquid discharge apparatuses that discharge liquid toward a medium in accordance with a liquid discharge job.

SUMMARY

An advantage of some aspects of the invention is that when a plurality of liquid discharge jobs are input, a liquid discharge apparatus capable of preventing deterioration of the print efficiency is provided.

Following, a description will be given of a mechanism and of advantages for solving the above-described problem. According to an aspect of the invention, there is provided a liquid discharge apparatus including a liquid discharge section including a nozzle configured to discharge liquid; a cap configured to change an open space of the nozzle of the liquid discharge section to a closed space; a liquid reception section configured to receive liquid discharged from the liquid discharge section; and a control section configured to discharge liquid from the liquid discharge section onto a medium on the basis of a liquid discharge job including a liquid discharge condition, wherein when discharge of liquid to the liquid reception section by the liquid discharge section is defined as flushing, and the cap forming the closed space is defined as capping, the control section causes liquid to be discharged in accordance with the liquid discharge job and then waits for an input of the next liquid discharge job while performing flushing, and if the next liquid discharge job is input before an elapsed time from completion of a liquid discharge based on the liquid discharge job exceeds a waiting time, the control section causes liquid to be discharged on the basis of the next liquid discharge job, and if the next liquid discharge job is not input before the elapsed time exceeds the waiting time, the control section causes the capping to be performed.

With the above-described configuration, liquid is discharged on the basis of the liquid discharge job, and then input of the next liquid discharge job is put on hold while flushing is being performed. Accordingly, if the next liquid discharge job is input, it is possible to terminate flushing and to discharge liquid early on the basis of the next liquid discharge job. That is to say, immediately after liquid is discharged on the basis of the liquid discharge job, the liquid discharge section is not capped, and thus if the next liquid discharge job is input, it is possible to shorten a time period required for releasing the capping, or the like. Accordingly, when a plurality of liquid discharge jobs are input, it is possible to prevent deterioration of the print efficiency.

On the other hand, if the elapsed time from the end of the liquid discharge based on the most recent liquid discharge job exceeds the waiting time, flushing while waiting for an input of a liquid discharge job is terminated and capping is performed. Accordingly, it is possible to prevent an increase in the amount of liquid consumption, which is caused by continuous flushing.

In the above-described liquid discharge apparatus, it is desirable that if the control section discharges liquid on the basis of the liquid discharge job for forming an adjustment pattern on the medium to confirm a discharge mode of the liquid, the control section cause the capping to be performed before the elapsed time exceeds the waiting time.

When an adjustment pattern is formed on the medium, a user of the liquid discharge apparatus often wants to confirm the adjustment pattern and to make adjustments of the liquid discharge apparatus. That is to say, in this case, there is a high possibility that the next liquid discharge job will not be input early.

Regarding this point, with the above-described configuration, when liquid is discharged on the basis of the liquid discharge job for forming an adjustment pattern on the medium, capping is performed before the elapsed time exceeds the waiting time. Accordingly, after liquid is discharged on the basis of the liquid discharge job for forming an adjustment pattern on the medium, in other words, when there is a high possibility that the next liquid discharge job will not be input until the waiting time passes, flushing while waiting for an input of the next liquid discharge job is performed so that it is possible to suppress the quantity of liquid to be discharged.

In the above-described liquid discharge apparatus, it is desirable that when a state in which the capping is carried out and the control section is waiting for an input of the liquid discharge job is defined as a first waiting state, and a state in which the flushing is performed until the elapsed time exceeds the waiting time, and the control section is waiting for an input of the liquid discharge job is defined as a second waiting state, if the liquid discharge job is an input in the first waiting state, the control section release the capping, then cause the flushing to be performed, and then discharge liquid on the basis of the liquid discharge job, and an intensity of the flushing in the second waiting state be lower than an intensity of the flushing after the liquid discharge job is input in the first waiting state.

When liquid is discharged on the basis of a liquid discharge job from the first waiting state, a state in which the liquid discharge section is not discharging liquid is sustained so that a liquid discharge defect might have occurred. Accordingly, in this case, flushing is performed in order to resolve a liquid discharge defect, and then liquid is discharged in accordance with a liquid discharge job. Further, In this case, flushing is performed with a relatively high intensity in order to resolve the liquid discharge defect.

In the above-described configuration, the flushing intensity in the second waiting state is lower than the flushing intensity after a liquid discharge job is input in the first waiting state. Accordingly, the quantity of liquid discharged from the liquid discharge section at the time of flushing in the second waiting state tends to be smaller than the quantity of liquid discharged from the liquid discharge section at the time of flushing after a liquid discharge job is input in the first waiting state. Accordingly, with this configuration, it is possible to prevent an increase in the amount of liquid consumed in the second waiting state.

In this regard, the flushing intensity mentioned here means that a large quantity of liquid is discharged. For example, even if the time period during which liquid is discharged is not changed, the flushing intensity may be increased by increasing the quantity of liquid discharged per unit time. Alternatively, even if the quantity of liquid discharged per unit time is not changed, the flushing intensity may be increased by extending the time period for discharging liquid.

It is desirable that the above-described configuration further include: a housing configured to accommodate the liquid discharge section; and a transport section configured to transport a medium onto which liquid is discharged by the liquid discharge section outside the housing, wherein when an area onto which liquid is discharged on the medium on the basis of the liquid discharge job is defined as a discharged liquid area, the waiting time is longer than a time period required from an end of a liquid discharge on the basis of the liquid discharge job to a point in time when the discharged liquid area is transported outside the housing.

With the above-described configuration, in a time period from the end of liquid discharge based on a liquid discharge job to at least a point in time when the discharged liquid area is transported outside the housing, a state of waiting for an input of the next liquid discharge job is sustained while flushing is performed. Accordingly, it becomes possible to input the next liquid discharge job after a user of the liquid discharge apparatus confirms the discharged liquid area and before the liquid discharge section is capped. That is to say, even if the next liquid discharge job is input after the user confirms an area onto which liquid was discharged (discharged liquid area) on the basis of the liquid discharge job, it is possible to discharge liquid early on the basis of the next liquid discharge job.

In the above-described liquid discharge apparatus, it is desirable that if the width of the medium is wide, the waiting time is increased over that of when the width of the medium is narrow.

The larger the area on which liquid is discharged, the larger the amount of information included in the liquid discharge job. Thus, it tends to take a longer time to transmit and receive a liquid discharge job and analyze the liquid discharge job. In other words, the smaller the area on which liquid is discharged, the smaller the amount of information included in the liquid discharge job. Thus, it tends to take a shorter time to transmit and receive a liquid discharge job and analyze the liquid discharge job.

Regarding this point, with the above-described configuration, the wider the medium, that is to say, the larger the area onto which liquid is to be discharged, the longer the waiting time. Accordingly, although much time is required to transmit and receive a liquid discharge job and analyze the liquid discharge job, the waiting time is shortened so that the time period before capping is performed is decreased, and thus it is possible to prevent deterioration of the liquid discharge efficiency. Also, although not so much time is necessary for transmitting and receiving a liquid discharge job and analyzing the liquid discharge job, the waiting time is extended so that if the next liquid discharge job is not input, it is possible to prevent an increase in the discharge rate of liquid by flushing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Following, a description will be given of an embodiment in which the liquid discharge apparatus is realized as a printer with reference to the drawings. In this regard, in the present embodiment, a printer is an ink jet printer that discharges ink as an example of a liquid onto a medium, such as a paper, or the like so as to form characters and images on the medium.

Figure 1:
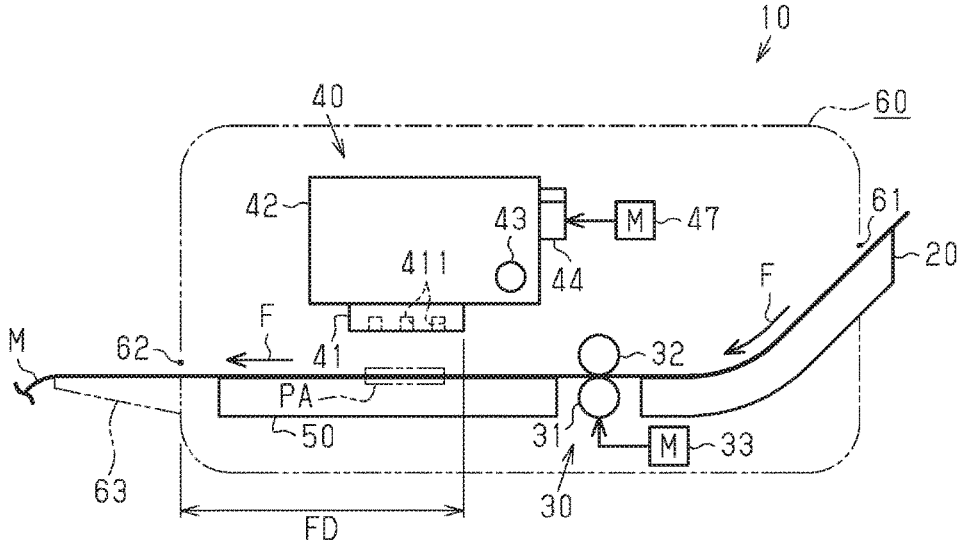
FIG. 1 is a sectional side view of a printer according to a first embodiment.
Figure 2:
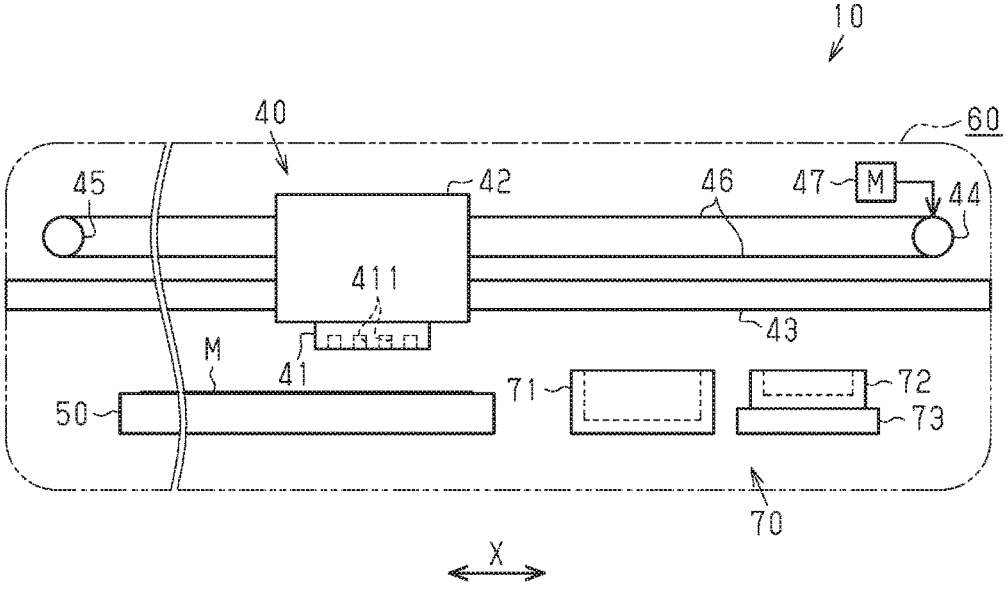
FIG. 2 is a sectional front view of the printer.

As illustrated in FIG. 1, a printer 10 includes a guide section 20 that guides a medium M in a transport direction of the medium M, a transport section 30 that transports the medium M, a printing section 40 that performs printing on the medium M, and a support section 50 that supports the medium M. Also, as illustrated in FIG. 1 and FIG. 2, the printer 10 includes a housing 60 that accommodates various components of the printer 10, and a maintenance section 70 that performs maintenance of the printing section 40.

In this regard, in the following description, the width direction of the printer 10 is also defined as the "width direction X", and the transport direction on the medium M is also referred to as the "transport direction F". In FIG. 1, the width direction X is the direction that crosses (is perpendicular to) the page, and the transport direction F is the direction that crosses (is perpendicular to) the width direction X. Also, in the width direction X, the end provided with the maintenance section 70 is also referred to as the "first end", and the end of the opposite side is also referred to as the "second end".

As illustrated in FIG. 1, the guide section 20 is curved vertically downward toward the front of the printer 10. Also, the guide section 20 is disposed throughout the inside and outside of the housing 60 of the printer 10. The guide section 20 then guides the medium M from the outside of the housing 60 toward the transport section 30. In this regard, in the present embodiment, the medium M may be a single-sheet medium or a continuous medium wound around a roll body.

The transport section 30 includes a drive roller 31 that is rotationally driven with the width direction X as the axial direction, a driven roller 32 that is driven with the width direction X as the axial direction, and a transport motor 33 that drives the drive roller 31. The drive roller 31 is disposed vertically below the transport path of the medium M, and the driven roller 32 is disposed vertically above the transport path. Also, the driven roller 32 is pressed against the drive roller 31. The transport section 30 then drives the transport motor 33 in a state of pinching the medium M guided from the guide section 20 between the drive roller 31 and the driven roller 32 so as to transport the medium M in the transport direction F.

As illustrated in FIG. 1 and FIG. 2, the printing section 40 includes a liquid discharge section 41 that discharges ink as an example of a liquid, a carriage 42 that supports the liquid discharge section 41 toward the support section 50, and a guide shaft 43 that supports the carriage 42 in a reciprocative manner in the width direction X. Also, as illustrated in FIG. 2, the printing section 40 includes a drive pulley 44 disposed on the first end side in the width direction X, a driven pulley 45 disposed on the second end side in the width direction X, a timing belt 46 that is wound by the drive pulley 44 and the driven pulley 45, and a carriage motor 47 that drives the drive pulley 44.

The liquid discharge section 41 is a so-called print head. Also, in the liquid discharge section 41, a plurality of nozzles 411 capable of discharging ink are opened. In the liquid discharge section 41 of the printer 10 capable of color printing, for example, the nozzles 411 that discharge ink of the same color in the transport direction F form a line, and a nozzle line corresponding to each color is formed to be arranged in the width direction X.

The printing section 40 then drives the carriage motor 47 so as to rotate the drive pulley 44 and the timing belt 46 wound around the driven pulley 45 and thereby moves the carriage 42 connected to the timing belt 46 in the width direction X. The printing section 40 then causes the liquid discharge section 41 to discharge ink toward the medium M while the carriage 42 moves in the width direction X so as to perform printing for one pass. Also, in the following description, nozzles 411 that become unable to normally discharge ink due to nozzle clogging, or the like are also referred to as "defective nozzles".

As illustrated in FIG. 1 and FIG. 2, the support section 50 is substantially a rectangular plate having the width direction X as the longer side direction and the transport direction F as the shorter side direction. Also, the support section 50 is disposed in an area opposite the reciprocating area of the liquid discharge section 41 when the carriage 42 reciprocates in the width direction X.

As illustrated in FIG. 1, the housing 60 accommodates the transport section 30, the printing section 40 (the liquid discharge section 41), and the support section 50. Also, the housing 60 includes a supply opening 61 through which the medium M passes when the medium M is supplied into the housing 60 before printing, an outlet 62 through which the medium M passes when the printed medium M is ejected to outside the housing 60, and a support frame 63 that supports the medium M that is ejected from the outlet 62.

Here, a distance along the transport path of the medium M from the nozzles 411 located at the most downstream side in the transport direction F to the outlet 62 is defined as a "minimum ejection distance FD". The minimum ejection distance FD is the transport distance required for ejecting the medium M to the support frame 63 immediately after having been subjected to the printing. Also, if the transport path is curved, the minimum ejection distance FD is the distance along the curved transport path.

As illustrated in FIG. 2, the maintenance section 70 is disposed in an area adjacent to the support section 50 in the width direction X. The maintenance section 70 includes a liquid reception section 71 that receives ink discharged from the liquid discharge section 41, a cap 72 that changes a space opened by the nozzles 411 of the liquid discharge section 41 to a closed space, and a lifting mechanism 73 that lifts and lowers the cap 72.

The liquid reception section 71 has a box-like shape having an opening in the vertically upward direction. The liquid reception section 71 then receives ink that is discharged by the liquid discharge section 41 for a purpose other than printing. In the following description, discharging ink by the liquid discharge section 41 for a purpose other than printing is referred to as "flushing". The flushing is performed in order to resolve a discharge defect of a defective nozzle or to prevent the occurrence of a defective nozzle.

The cap 72 has a box-like shape having an opening in the vertically upward direction. The cap 72 is formed of a material having elasticity, such as rubber, or the like at least at an upper end. Also, the cap 72 is capable of moving in a direction crossing the open surface of the nozzles 411 of the liquid discharge section 41 (in the vertically upward direction in this embodiment) by being driven by the lifting mechanism 73.

The cap 72 is then moved toward the liquid discharge section 41 so as to touch the liquid discharge section 41 and performs "capping" that changes the open space of the nozzles 411 of the liquid discharge section 41 to a closed space. Also, the cap 72 is moved away from the liquid discharge section 41 in the state of having performed capping so as to release capping.

In this regard, the capping is performed in order to prevent a solvent component of the ink in the liquid discharge section 41 from evaporating through the nozzles 411 when a state of not discharging ink from the liquid discharge section 41 is sustained. Accordingly, the capping is performed when the power to the printer 10 is turned off or when printing is not performed in the power-on state of the printer 10.

Also, it is desirable that the closed space formed by capping be a blocked state for fluid (for example, ink or air) entering and exiting the inside of the cap 72 from and to the outside. However, the closed space may be in a state of permitting a small quantity of fluid to come and go.

Next, a description will be given of the electrical configuration of the printer 10 with reference to FIG. 3.

Figure 3:
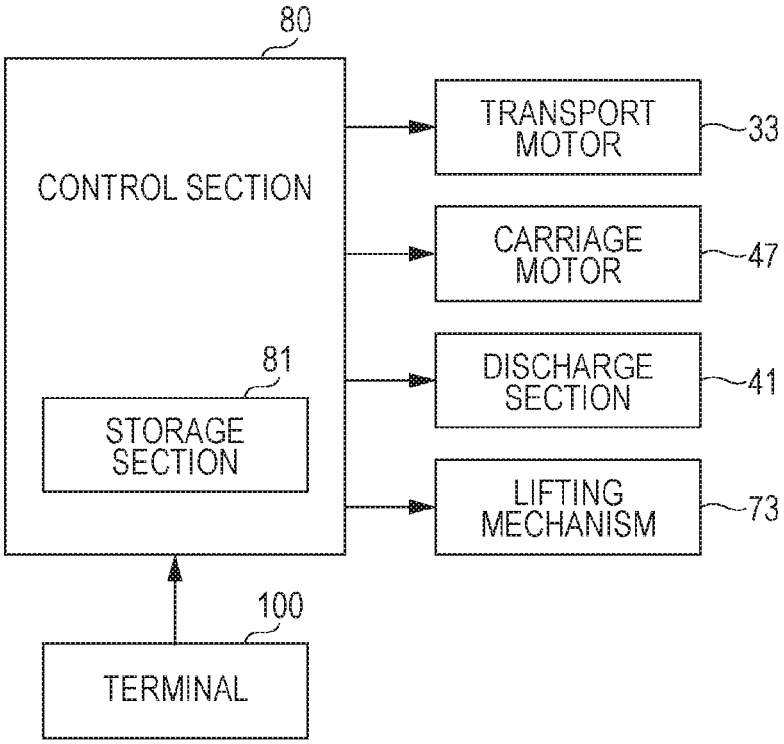
FIG. 3 is a block diagram illustrating an electrical configuration of the printer.

As illustrated in FIG. 3, the printer 10 includes a control section 80 that enables full control of the apparatus. The control section 80 includes a storage section 81 that stores various kinds of information of the printer 10. Here, the control section 80 corresponds to a so-called CPU or a microcomputer, and the storage section 81 corresponds to a ROM and a RAM.

A terminal 100 that transmits a print job (hereinafter also referred to as a "print job Jb") to the printer 10 is connected to an interface on the input side of the control section 80, and a transport motor 33, a carriage motor 47, a liquid discharge section 41, and a lifting mechanism 73 are connected to an interface on the output side of the control section 80. In this regard, in the present embodiment, the terminal 100 is a personal computer, a smartphone, or the like that is connected in a wireless or wired manner to the control section 80.

The control section 80 then receives the print job Jb transmitted from the terminal 100 and analyzes the contents of the print job Jb so as to determine the drive mode of the transport motor 33, the carriage motor 47, and the liquid discharge section 41. Next, the control section 80 alternately performs a discharge operation that discharges ink from the liquid discharge section 41 while moving the carriage 42 in the transport direction F and a transport operation that transports the medium M by a predetermined amount in the transport direction F so as to perform printing on the medium M.

In this regard, a print job Jb is a print command including information on print contents, such as an image, or the like to be printed on the medium M. That is to say, a print job Jb includes a condition for the discharge of ink by the liquid discharge section 41. From this point of view, in the present embodiment, a "print job Jb" corresponds to an example of the liquid discharge job. Also, as illustrated in FIG. 1, in the discharge operation at the time of printing based on a print job Jb, it is assumed that an area of the medium M on which ink is discharged is defined as a "discharged liquid area PA".

On the other hand, if a plurality of print jobs Jb are input into the printer 10, the storage section 81 stores the plurality of print jobs Jb in a first-in first-out list structure (queue) in order of input. That is to say, if the storage section 81 stores a plurality of print jobs Jb, the control section 80 controls the printing section 40 and the like such that a print job Jb previously stored in the storage section 81 is subjected to printing earlier.

Incidentally, in the present embodiment, it is assumed that among print jobs Jb, a print job Jb for printing characters and images is a "first print job Jb1", and a print job Jb for printing an adjustment pattern in order to confirm the information indicating the state of the printer 10 and the discharge mode of the liquid discharge section 41 is a "second print job Jb2". That is to say, a first print job Jb1 is intended for obtaining printed matter based on the first print job Jb1, and a second print job Jb2 is intended for confirming the state of the printer 10 using the printed matter based on the second print job Jb2 or for making adjustments to the printer 10.

The adjustment patterns mentioned in the present embodiment may include the following patterns, for example.

- Pattern for checking whether or not there is a defective nozzle in the liquid discharge section 41
- Pattern for adjusting an impact position of ink when one-way printing, in which the liquid discharge section 41 discharges ink, is performed only in the case where the carriage 42 moves from one end to the other end in the width direction X
- Pattern for adjusting an impact position of ink at the time when the carriage 42 moves to the second end and an impact position of ink at the time when the carriage 42 moves to the first end in the case where the carriage 42 performs bi-directional printing in which the liquid discharge section 41 discharges ink both when the carriage 42 moves from the first end to the second end and when the carriage 42 moves from the second end to the first end
- Pattern for adjusting an impact position of ink in accordance with the thickness of the medium M supported by the support section 50
- Pattern for adjusting the amount of rotation of the transport motor 33 that drives the drive roller 31 when the transport distance of the medium M during one rotation of the drive roller 31 varies Also, it is assumed that the adjustment pattern of the present embodiment includes a table (status sheet) of the amount of remaining ink, various settings, and the like of the printer 10 in order to facilitate the printing purpose.

Next, a description will be given of a processing routine for performing printing when the control section 80 in the present embodiment performs printing on the basis of the print job Jb (print data) with reference to the flowcharts in FIG. 4 and FIG. 5. In this regard, this processing routine is a processing routine that is repeatedly executed for each control cycle set in advance. Also, it is assumed that when this processing routine is started, the liquid discharge section 41 is capped.

Figure 4:
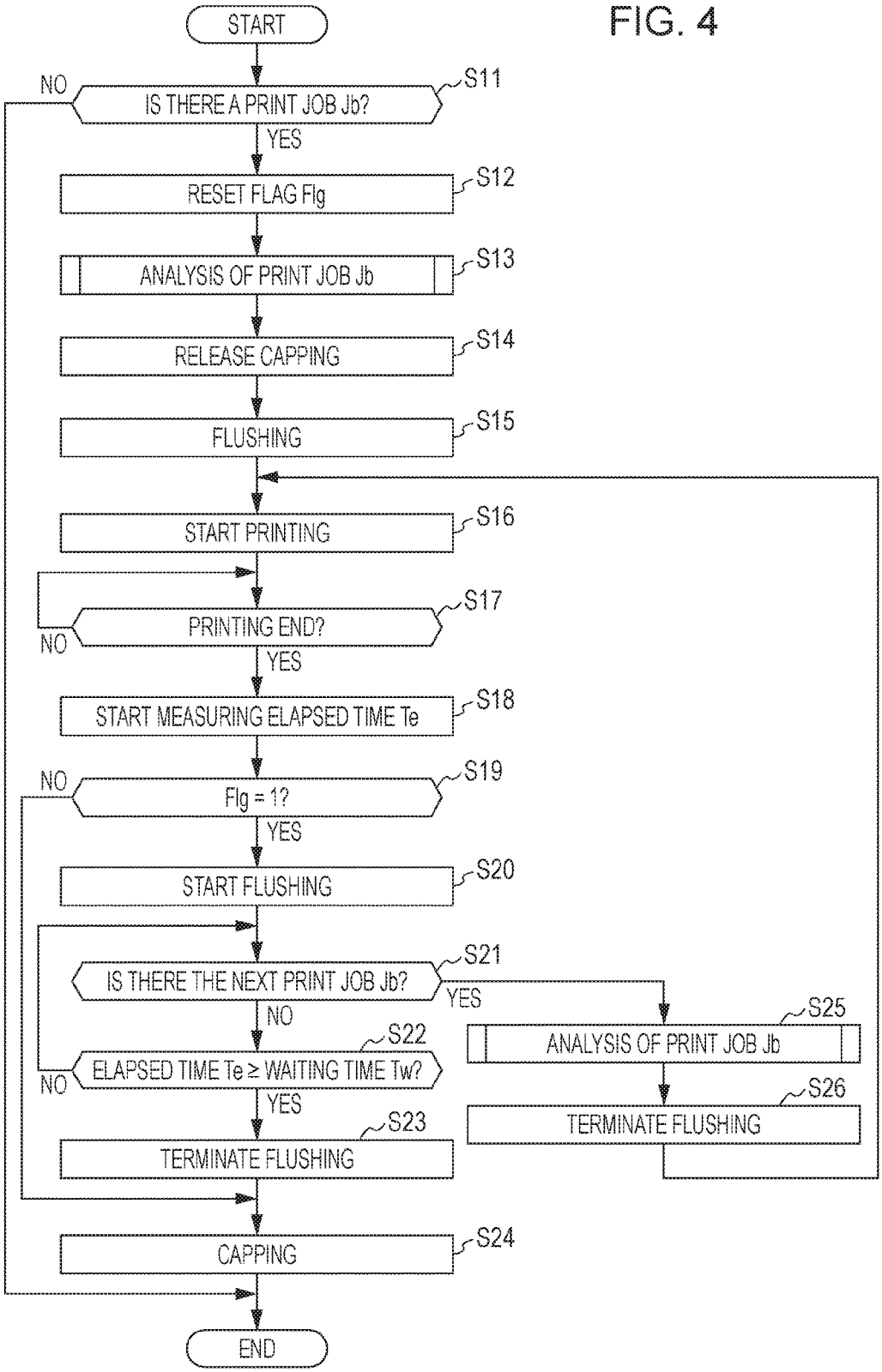
FIG. 4 is a flowchart illustrating a processing routine executed by a control section of the printer for performing printing.

As illustrated in FIG. 4, in this processing routine, the control section 80 determines whether there is a print job Jb or not (step S11). That is to say, at the time of executing this processing routine, a determination is made as to whether or not a print job Jb has been input from the terminal 100, or whether there is a print job Jb in the storage section 81 or not.

If there are no print jobs Jb (step S11: NO), the control section 80 terminates this processing routine once. That is to say, in this case, the control section 80 waits for an input of a print job Jb in the state in which the liquid discharge section 41 is capped.

On the other hand, if there is a print job Jb (step S11: YES), a flag Flg indicating the print contents of the print job Jb is reset (initialized) (step S12). Here, the flag Flg is a variable in which "1" or "2" is set in accordance with the contents of the print job Jb to be processed by the control section 80 from now on. If "1" is set in the flag Flg, it represents that the print job Jb to be subjected to printing by the printing section 40 is the first print job Jb1 for printing images, and the like. Also, if "2" is set in the flag Flg, it represents that the print job Jb to be subjected to printing by the printing section 40 is the second print job Jb2 for printing the adjustment pattern.

The control section 80 then executes a subroutine for analyzing the print job Jb (step S13). Although the details will be described later, in step S13, the contents of the print job Jb is analyzed so that a value is set to the flag Flg. In this regard, a time period (hereinafter also defined as an "analysis time") required for the analysis of the print job Jb changes by the contents of the print job Jb. For example, the larger the image to be printed by a certain print job Jb, the longer the analysis time, and the larger the number of pixels of the image to be printed by a certain print job Jb, the longer the analysis time.

When the analysis of the print job Jb is completed, the control section 80 causes the capping to be released (step S14), and causes the liquid discharge section 41 to perform flushing (step S15). More specifically, after the control section 80 lowered the cap 72, the control section 80 moves the carriage 42 in the width direction X such that the liquid discharge section 41 is opposed to the liquid reception section 71. The liquid discharge section 41 then discharges ink to the liquid reception section 71.

In this regard, the flushing in step S15 is performed before the printing in accordance with the input print job Jb is started in order to resolve a discharge defect that might occur at the time of the capping. Accordingly, it is desirable that the longer the time period of having performed capping, the higher the intensity of the flushing in step S15 be set.

In this manner, when the preparations for starting printing are made, the control section 80 starts printing in accordance with the print job Jb analyzed in step S13 (step S16). Here, as described above, when printing is performed in accordance with the print job Jb, the control section 80 alternately performs a discharge operation and a transport operation. In this regard, when printing is performed on the basis of the print job Jb, out of the discharge operation and the transport operation that are alternately performed, in the last transport operation that is performed next to the last discharge operation, the transport distance of the medium M is set to the "minimum ejection distance FD" or more. That is to say, by performing the last transport operation, the discharged liquid area PA produced by the last discharge operation is ejected to the outside of the housing 60.

The control section 80 then determines whether or not the printing in accordance with the print job Jb has been completed (step S17), if the printing has not been completed (step S17: NO), the processing of step S17 is executed again. On the other hand, if the printing in accordance with the print job Jb has been completed (step S17), the control section 80 starts measuring the elapsed time Te (step S18) from the completion timing of the printing (the timing at which the processing of step S17 is determined as affirmative).

Next, the control section 80 determines whether or not the flag Flg is set to "1" (step S19). If the flag Flg is set to "2" (step S19: NO), that is to say, if the print job Jb that has completed printing is the second print job Jb2 for printing the adjustment pattern, the processing proceeds to step S24 described below.

On the other hand, if the flag Flg is set to "1" (step S19: YES), that is to say, if the print job Jb that has completed printing is the first print job Jb1 for printing images, and the like, the control section 80 causes the liquid discharge section 41 to start flushing (step S20). That is to say, in the same manner as step S15, the control section 80 moves the carriage 42 in the width direction X so that the liquid discharge section 41 is opposed to the liquid reception section 71, and causes the liquid discharge section 41 to discharge ink to the liquid reception section 71. However, the purpose of the flushing in step S20 is to prevent the occurrence of a defective nozzle, so that the intensity thereof is made relatively low.

The control section 80 then determines whether there is the next printing job Jb or not in the state in which the liquid discharge section 41 has performed flushing (step S21). Here, the next print job Jb may be a print job Jb stored in the list structure (queue) by the storage section 81, or may be a print job Jb transmitted from the terminal 100 at the timing of executing step S21.

If there is not the next print job Jb (step S21: NO), the control section 80 determines whether or not the elapsed time Te from the end of the printing based on the previous print job Jb becomes equal to or longer than the waiting time Tw (step S22). In this regard, the waiting time Tw is a determination value for determining whether or not the elapsed time Te has become long, and is desirable to be set in advance. Also, in the present embodiment, it is assumed that measuring the elapsed time Te is started at a point in time when the last discharge operation based on the print job Jb is completed, in other words, at a point in time when the last transport operation based on the print job Jb is started.

If the elapsed time Te is less than the waiting time Tw (step S22: NO), the processing of the control section 80 proceeds to step S21. That is to say, in this case, the liquid discharge section 41 continues flushing until the next print job Jb is input.

On the other hand, if the elapsed time Te is equal to or longer than the waiting time Tw (step S22: YES), that is to say, if the next print job Jb is not input even if an input of the next print job Jb is waited for a time period corresponding to the waiting time Tw, the control section 80 terminates the flushing by the liquid discharge section 41 (step S23). In step S24, the control section 80 then causes the cap 72 to perform capping on the liquid discharge section 41 and after that terminates this processing routine once. More specifically, the control section 80 moves the carriage 42 in the width direction X so that the liquid discharge section 41 and the cap 72 are opposed. The cap 72 then is lifted so as to touch the liquid discharge section 41.

On the other hand, if there is the next print job Jb in step S21 (step S21: YES), the control section 80 analyzes the next print job Jb (step S25). When the analysis of the next print job Jb is completed, the control section 80 terminates flushing of the liquid discharge section 41 (step S26), and the processing proceeds to step S16. That is to say, in this case, printing in accordance with the next print job Jb is started.

In this regard, in step S19, if the flag Flg is set to "2" (step S19: NO), the control section 80 causes the liquid discharge section 41 to be capped (step S24). That is to say, if printing is performed in accordance with the second print job Jb2 for printing the adjustment pattern, the processing of steps S21 and S22 are not performed, but capping is carried out. Accordingly, in this case, capping is performed before the elapsed time Te from the end of the printing exceeds the waiting time Tw.

Also, the intensity (hereinafter also defined as a "second intensity") of the flushing that is started in step S20 with the purpose of preventing the occurrence of a discharge defect is set to lower than the intensity (hereinafter also defined as a "first intensity") of the flushing that is performed in step S15 with the purpose of recovering from a discharge defect. Here, a high intensity of flushing means a larger amount of ink discharged from the nozzles 411, and a low intensity of flushing means a smaller amount of ink discharged from the nozzles 411.

That is to say, if it is assumed that the discharge rate of ink per unit time in the flushing in step S15 is equal to the discharge rate of ink per unit time in the flushing in step S20, a time period of continuing flushing in step S15 is set longer than a time period of continuing flushing in step S20. Also, if it is assumed that the time period of continuing flushing in step S15 is equal to the time period of continuing flushing in step S20, the discharge rate of ink per unit time in the flushing in step S15 is set to higher than the discharge rate of ink per unit time in the flushing in step S20.

Accordingly, it is possible to say that the above-described waiting time Tw is set such that the amount of ink discharged from the liquid discharge section 41 from a point in time when step S20 is executed to a point in time when the elapsed time Te becomes equal to or longer than the waiting time Tw becomes smaller than the amount of ink discharged from the liquid discharge section 41 when the processing in step S15 is executed.

On the other hand, in the present embodiment, the waiting time Tw is set longer than a time period required from a point in time when discharging ink in accordance with the print job Jb is completed to a point in time when the discharged liquid area PA in which ink has been discharged to the medium M in accordance with the print job Jb is transported to the outside of the housing 60.

Next, a description will be given of the analysis processing routine of the print job Jb in steps S13 and S25 with reference to FIG. 5.

Figure 5:
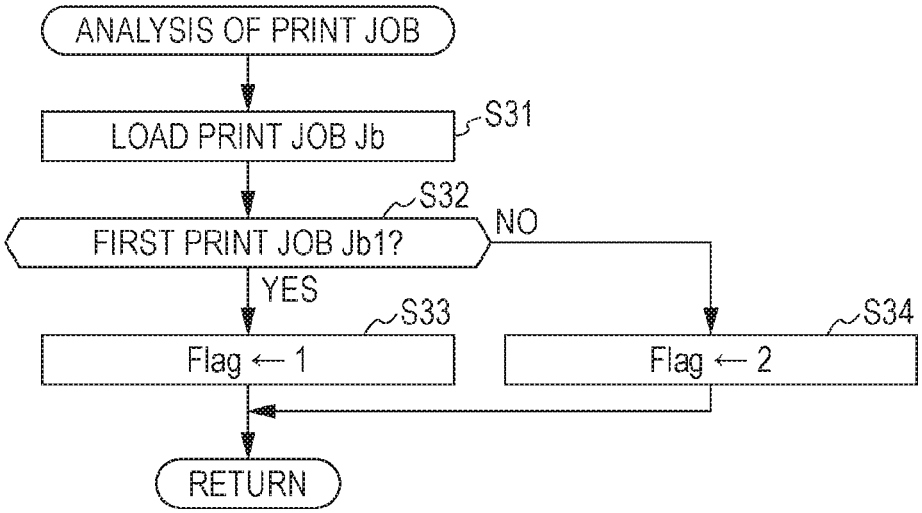
FIG. 5 a flowchart illustrating a processing routine executed by the control section of the printer for analyzing a print job.

As illustrated in FIG. 5, the control section 80 loads the contents of the print job Jb (step S31), and determines whether or not the print job Jb is the first print job Jb1 for printing images, and the like (step S32). If the print job Jb is the first print job Jb1 (step S32: YES), the control section 80 sets the flag Flg to "1" (step S33), and the processing routine is terminated once. On the other hand, if the print job Jb is the second print job Jb2 (step S32: NO), the control section 80 sets the flag Flg to "2" (step S34), and the processing routine is terminated once.

Next, a description will be given of the operations of the printer 10 in the present embodiment in the case where two first print jobs Jb11 and Jb12, and one second print job Jb2 are input with reference to FIG. 6.

Figure 6:
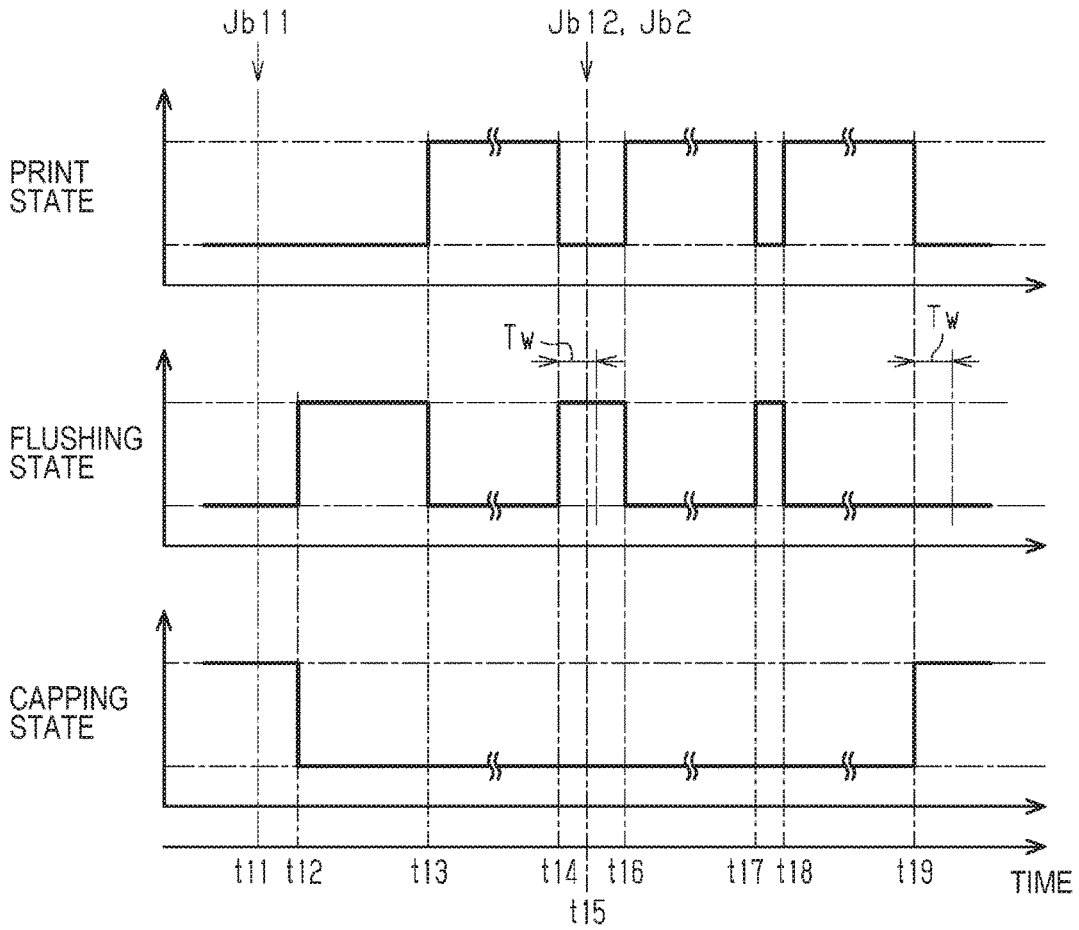
FIG. 6 is a timing chart illustrating changes of the states of various configurations when the printer performs printing.

In this regard, FIG. 6 illustrates a printing state in which whether or not printing is in process is expressed by a binary value, a flushing state in which whether or not flushing is in process is expressed by a binary value, and a capping state in which whether or not capping is in process is expressed by a binary value. Also, in FIG. 6, one of the binary values having a higher value in the vertical axis indicates in process of printing, in process of flushing, and in process of capping. Further, in FIG. 6, for the sake of simplicity of the description, the operations that are actually executed at the timing that are shifted with each other are illustrated to be executed at the same timing.

As illustrated in FIG. 6, before a first print job Jb11 is input (before a first timing t11), printing and flushing are not performed, but the liquid discharge section 41 is capped. From this point, a time period until the first timing t11 is the "first waiting state" in which an input of a print job Jb is waited in a state in which the printer 10 is capped.

Next, at the first timing t11, when the first print job Jb11 is input into the printer 10, the analysis of the first print job Jb11 is started while the liquid discharge section 41 is capped.

At the second timing t12 when the analysis of the first print job Jb11 is completed, the capping of the liquid discharge section 41 is released, and flushing is started with the first intensity. The flushing that is started at the second timing t12 is sustained until the next third timing t13, and thus a discharge defect of the liquid discharge section 41 caused by the capping is released.

Next, at a third timing t13, printing based on the first print job Jb11 is started after the flushing is completed. Also, the printing based on the first print job Jb11 continues until the fourth timing t14 next to the third timing t13. Incidentally, it is usual that the time period (printing period) from the third timing t13 to the fourth timing t14 becomes longer than the time period (flushing period) from the second timing t12 to the third timing t13.

At the fourth timing t14, when printing based on the first print job Jb11 is completed, flushing is started. That is to say, at the fourth timing t14, it is in a state in which a print job Jb to be processed next is not stored in the list structure (queue) of the storage section 81. Accordingly, an input of the next print job Jb is waited, and thus flushing is started with the second intensity. Thus the time period from the fourth timing t14 becomes the "second waiting state" in which an input of a print job Jb is waited in a state in which the printer 10 has caused the liquid discharge section 41 to perform flushing before the elapsed time Te exceeds the waiting time Tw.

Next, at a fifth timing t15, the first print job Jb12 and the second print job Jb2 are input into the printer 10. Accordingly, at the fifth timing t15, the analysis of the first print job Jb12 is started and the second print job Jb2 is stored in the storage section 81. Also, the fifth timing t15 is a timing after the fourth timing t14 at which the printing based on the first print job Jb12 is completed and before the timing at which the waiting time Tw passes from the fourth timing t14. Accordingly, at the fifth timing t15, the printing in accordance with the first print job Jb12 is started without the liquid discharge section 41 being capped.

At a sixth timing t16 when the analysis of the first print job Jb12 is completed, in the same manner as at the third timing t13, the printing based on the first print job Jb12 is started after the flushing is completed. Next, at a seventh timing t17, when the printing based on the first print job Jb12 is completed, the flushing is started with the second intensity. Here, at the seventh timing t17, the second print job Jb2 that was input at the fifth timing t15 as the print job Jb to be processed is stored in the storage section 81. Accordingly, at the seventh timing t17, the analysis of the second print job Jb2 is started without becoming the second waiting state.

Next, at an eighth timing t18 when the analysis of the second print job Jb2 is completed, the flushing is completed in the same manner as at the third timing t13 and at the sixth timing t16, and the printing based on the second print job Jb2 is started. Next, at a ninth timing t19, when the printing based on the second print job Jb2 is completed, capping is performed.

That is to say, at the ninth timing t19 when the printing based on the second print job Jb2 for printing the adjustment pattern is completed, capping is performed without causing the liquid discharge section 41 to perform flushing unlike at the fourth timing t14 and at the seventh timing t17 when the printing based on the first print jobs Jb11 and Jb12 for printing images, and the like are completed. Also, at the ninth timing t19 and thereafter, various states of the printer 10 are confirmed, and various adjustments on the printer 10 are made by a user who have confirmed a printed matter based on the second print job Jb2.

In this regard, in terms of the liquid discharge section 41 being capped, the liquid discharge apparatus goes to the "first waiting state" in which an input of a print job Jb is waited in a state of having been capped at the ninth timing t19 and thereafter.

By the above-described embodiment, it is possible to obtain the advantages described below.

(1) After printing in accordance with the print job Jb is performed, an input of the next print job Jb is waited while performing flushing, and thus if the next print job Jb is input, it is possible to terminate the flushing, and to start the printing based on the next print job Jb early. That is to say, the liquid discharge section 41 is not capped, and thus it is not necessary to release capping, or perform flushing after releasing the capping, or the like before starting printing based on the next print job Jb. Accordingly, when a plurality of print jobs Jb are input, it is possible to prevent deterioration of the print efficiency.

On the other hand, when the elapsed time Te from the end of ink discharge based on the most recent print job Jb becomes equal to or longer than the waiting time Tw, the flushing while waiting for an input of the print job Jb is terminated, and capping is performed. Accordingly, it is possible to prevent an increase in the amount of ink consumption, which is caused by continuation of flushing in order to wait for the next print job Jb.

(2) When an adjustment pattern is formed on the medium M, a user of the printer 10 often considers confirming the formed adjustment pattern, and wants to make adjustments of the printer 10. That is to say, in this case, there is a high possibility that the next print job Jb is not input early.

Regarding this point, with the above-described embodiment, when printing is performed in accordance with the second print job Jb2 for forming the adjustment pattern on the medium M, capping is performed before the elapsed time Te exceeds the waiting time Tw. Accordingly, after printing is performed in accordance with the second print job Jb2 for forming the adjustment pattern on the medium M, in other words, when there is a high possibility that the next print job Jb is not input until the waiting time Tw passes, flushing is performed in order to wait for an input of the next print job Jb so that it is possible to suppress the amount of discharge ink.

(3) When ink is discharged on the basis of the print job Jb from the first waiting state in which an input of a print job Jb is waited while capping is performed, the state in which the liquid discharge section 41 is not discharging ink continues so that an ink discharge defect sometimes occurs. Accordingly, in this case, flushing is performed in order to resolve the ink discharge defect, and then ink is discharged in accordance with the print job Jb. Further, in this case, in order to resolve the ink discharge defect, flushing is performed with a relatively high intensity (the first intensity).

Also, in the above-described embodiment, the flushing intensity (the second intensity) in the second waiting state in which an input of the print job Jb is waited while flushing is performed is set lower than the flushing intensity (the first intensity) of the flushing performed before starting printing from the first waiting state. Accordingly, the amount of ink discharged from the liquid discharge section 41 at the time of flushing in the second waiting state tends to be smaller than the amount of ink discharged from the liquid discharge section 41 at the time of flushing performed before starting printing from the first waiting state. Accordingly, it is possible to reduce a larger amount of ink consumed by flushing until printing is performed in accordance with the next print job Jb that is input after that than the case of changing to the first waiting state after printing is performed in accordance with the print job Jb.

(4) From the end of ink discharge based on the print job Jb to when at least the discharged liquid area PA is transported to the outside of the housing 60, a state in which input of the next print job Jb is waited while flushing is performed continues. Accordingly, after a user of the printer 10 confirms the discharged liquid area PA, it becomes possible for the user to input the next print job Jb before the liquid discharge section 41 is capped. That is to say, when the user confirms the printing result based on the previous print job Jb, and then inputs the next print job Jb, it is possible to perform printing in accordance with the next print job Jb early.

In this regard, the above-described embodiment may be changed as described below.

When printing in accordance with a print job Jb is performed, the wider the area in which ink is discharged, the larger the amount of information included in the print job Jb, and the longer time tends to be required for transmitting and receiving the print job Jb, and for the control section 80 to analyze the print job Jb. Also, if the area in which ink is discharged is wide, the width Wm of the medium M set in the printer 10 tends to become wide in the width direction X. Thus, a part of the flowchart illustrated in FIG. 4 may be changed to a flowchart as illustrated in FIG. 7.

Figure 7:
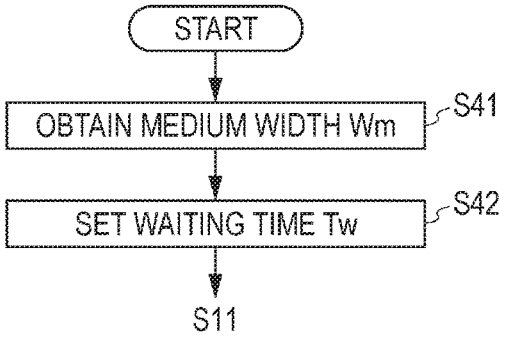
FIG. 7 is a flowchart illustrating a part of a processing routine according to a variation.
Figure 8:
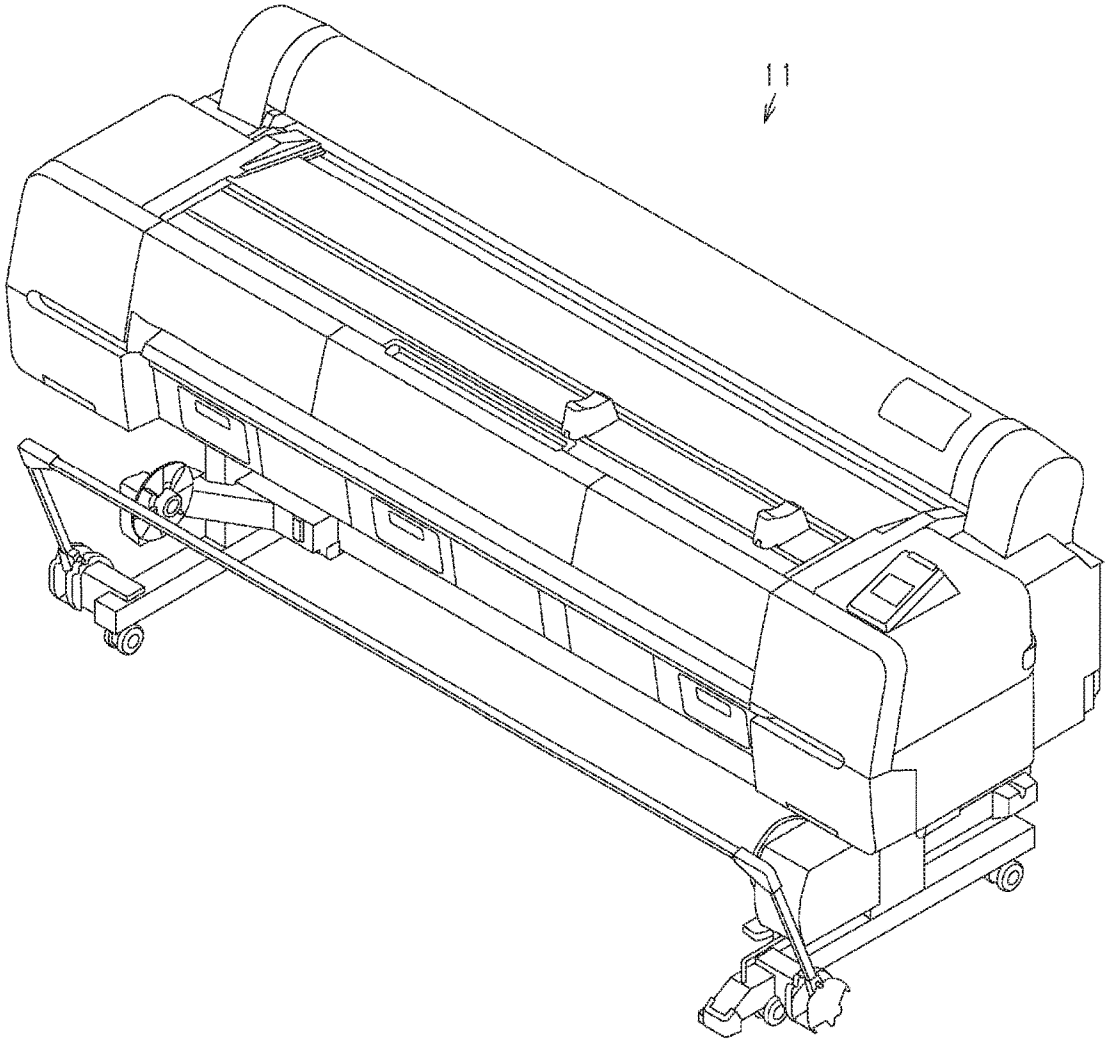
FIG. 8 is a first perspective view of a large format printer according to an embodiment.
Figure 9:
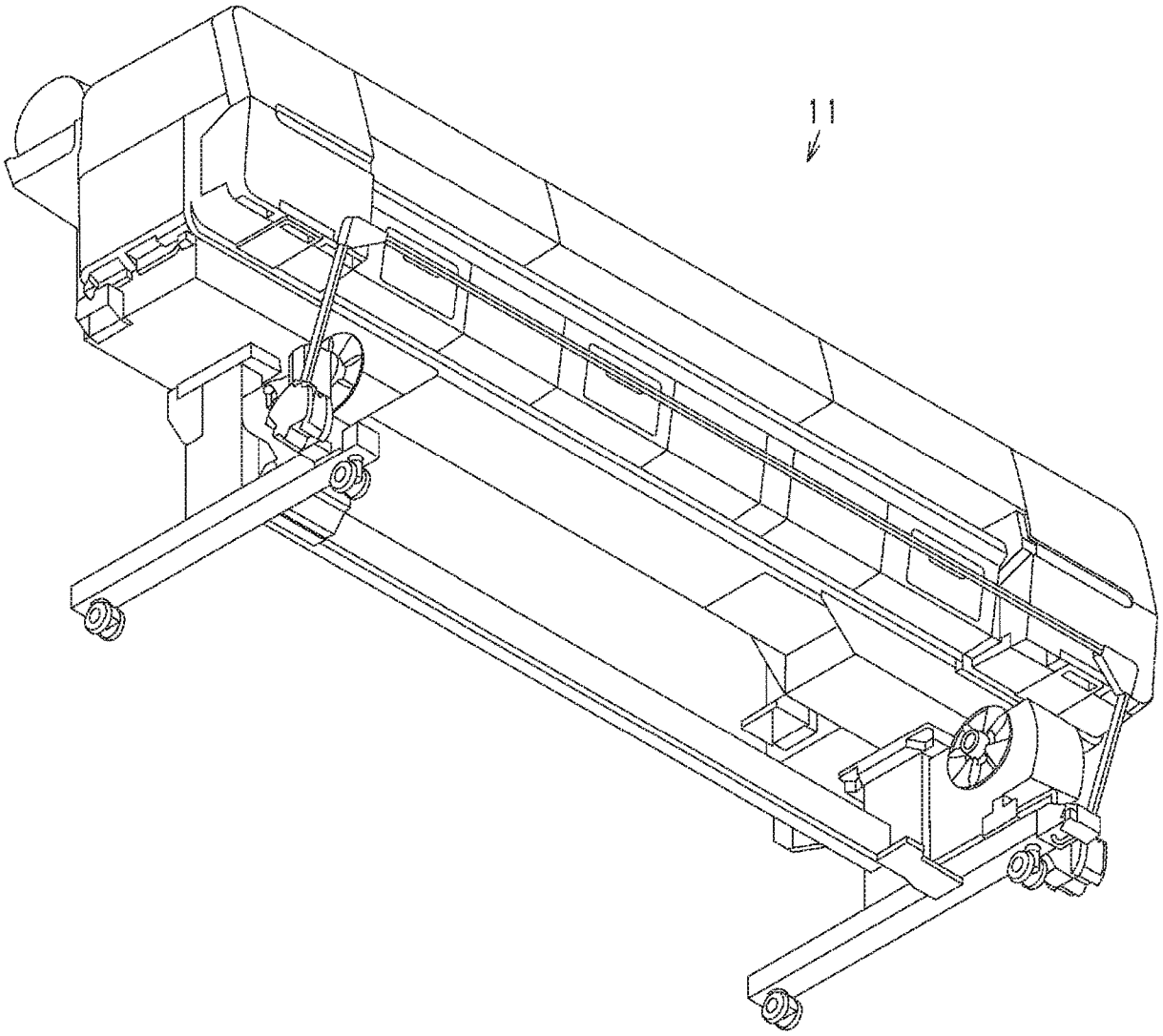
FIG. 9 is a second perspective view of a large format printer according to an embodiment.
Figure 10:
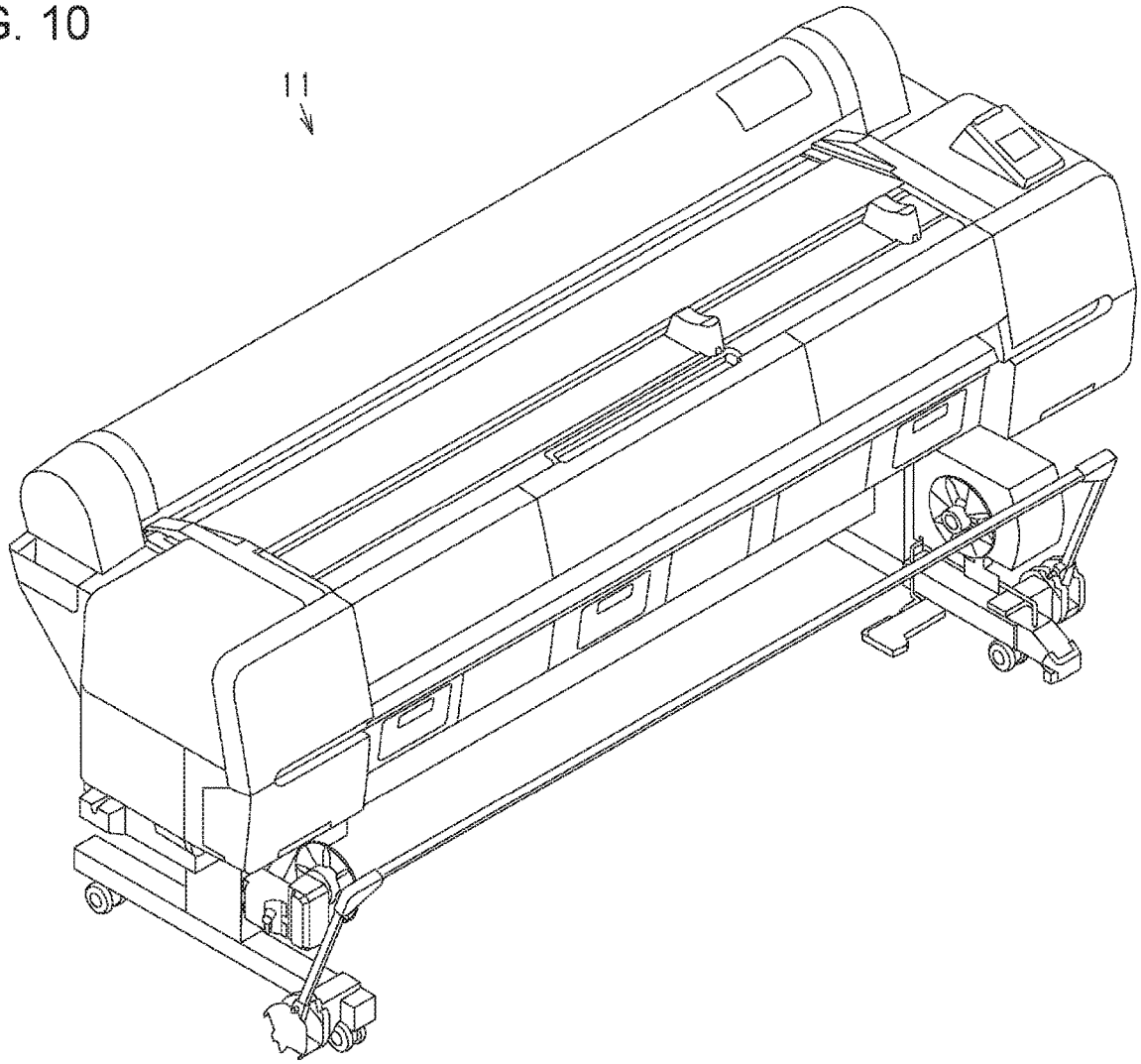
FIG. 10 is a third perspective view of a large format printer according to an embodiment.
Figure 11:
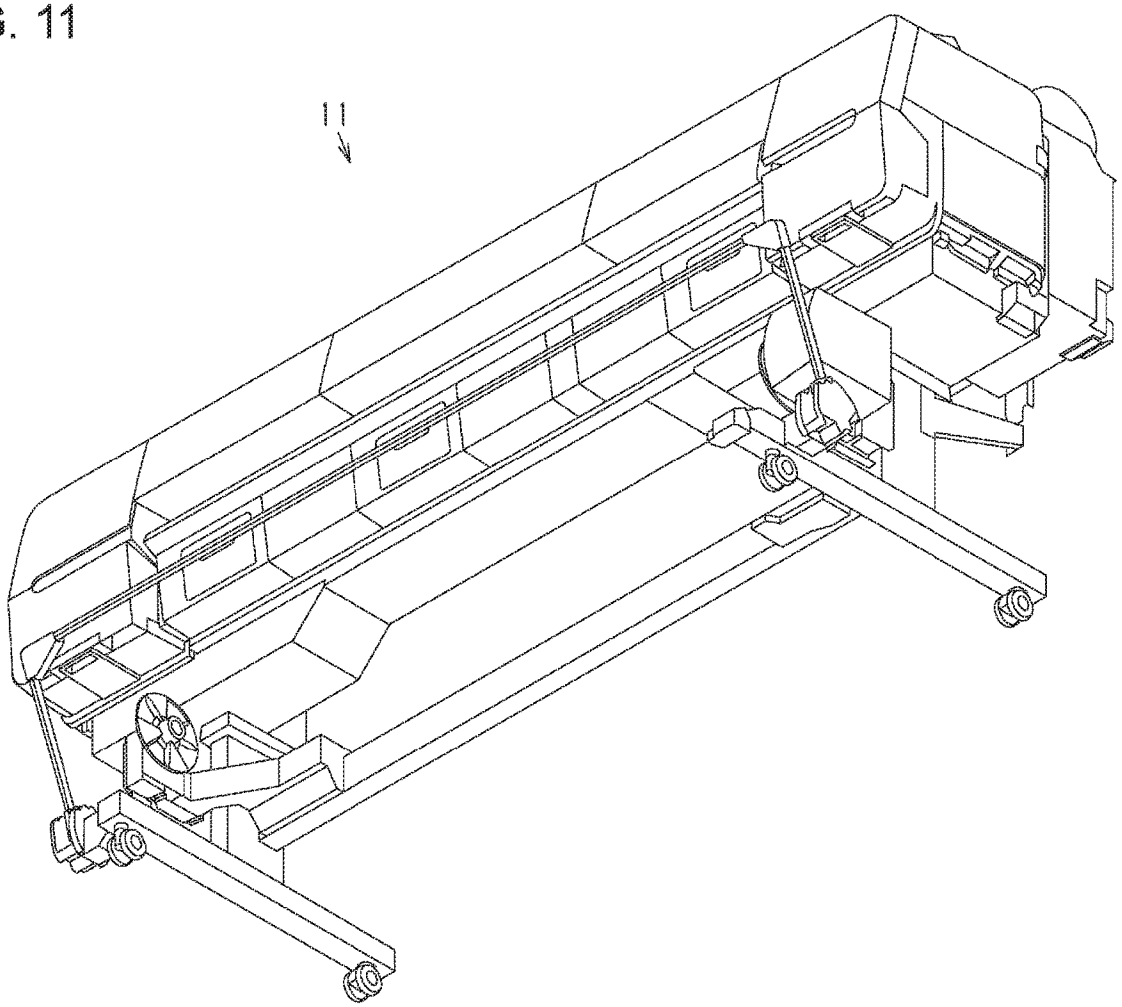
FIG. 11 is a fourth perspective view of a large format printer according to an embodiment.
Figure 12:
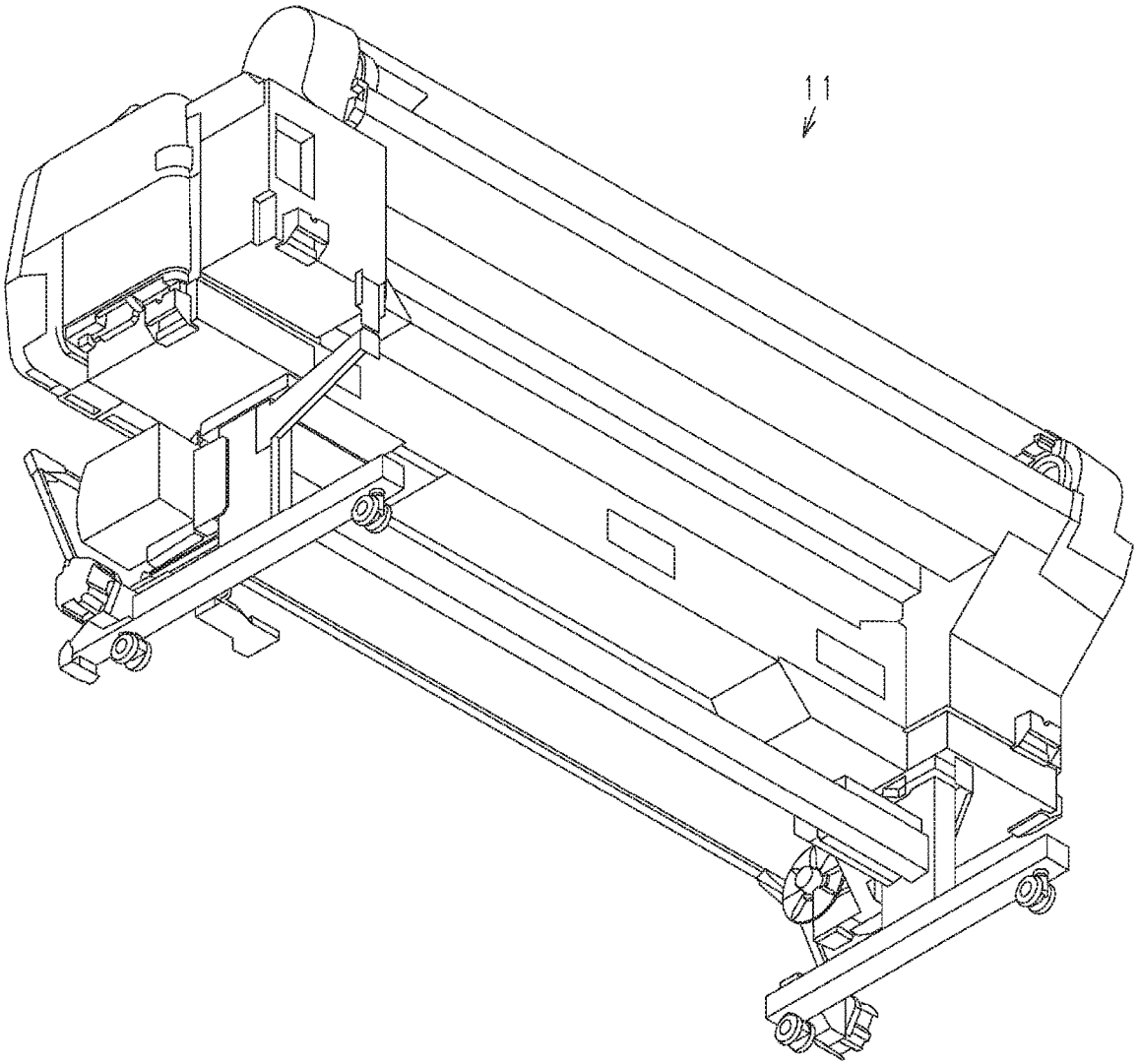
FIG. 12 is a fifth perspective view of a large format printer according to an embodiment.

As illustrated in FIG. 7, in this processing routine, the control section 80 obtains the width Wm of the medium M (step S41). If a detection section that detects the width Wm of the medium M is provided, the width Wm of the medium M may be obtained on the basis of the output result of the detection section, or may be obtained by the input of a user. If the width Wm of the medium M is wide, the control section 80 sets the waiting time Tw longer than that of the case in which the width is narrow (step S42), and the processing thereof will proceed to step S11.

With this configuration, the waiting time Tw is shortened although it takes much time to transmit and receive the print job Jb and to analyze the print job Jb, and thus a time period before the capping is performed is decreased. Thereby, it is possible to prevent deterioration of the print efficiency. Also, the waiting time Tw is extended although it does not take much time to transmit and receive the print job Jb and to analyze the print job Jb. Thus, it is possible to prevent an increase in the discharge rate of ink by flushing in the case where the next print job Jb is not input.

Depending on whether the print job Jb is the first print job Jb1 or the second print job Jb2, the processing after that does not need to be changed. That is to say, in the flowchart illustrated in FIG. 4, even if the flag Flg is set to "2", the processing may proceed to step S20.

In the above-described embodiment, in the last transport operation when printing is performed, the medium M is transported until the discharged liquid area PA of the medium M is ejected to the outside of the housing 60. However, it is not necessary to do so.

If there is a nozzle 411 that has not been discharging ink for some time from the start of the printing out of a plurality of nozzles 411 formed on the liquid discharge section 41, the flushing that discharges ink at least from that nozzle 411 may be performed between the transport operation and the discharge operation.

Flushing may be performed by discharging ink once from one of the nozzles 411, or by discharging ink a plurality of times from one of the nozzles 411. Also, flushing may be performed while the carriage 42 is stopped, or while the carriage 42 is being moved in the width direction X. Also, flushing may be performed by discharging ink from all of the nozzles 411 at the same time, or by changing the nozzles 411 that discharge ink with time.

Flushing may be performed toward the medium M. In this case, the medium M corresponds to an example of the liquid reception section 71. Also, flushing may be performed toward the cap 72. In this case, the cap 72 corresponds to an example of the liquid reception section 71.

The printer 10 may be provided with an operation section that receives an operation from a user. In this case, the printer 10 may perform printing in accordance with the first print job Jb1 and the second print job Jb2 that are input through the operation section.

The liquid discharge apparatus may be changed to a so-called linehead-type liquid discharge apparatus including a long fixed liquid discharge section 41 corresponding to the total width of the medium M without including the carriage 42. In this case, in the liquid discharge section 41, a plurality of unit head sections on which a nozzle 411 for discharging liquid as a droplet is formed may be arranged in parallel so that the recording range extends over the total width of the medium M. Alternatively, a large number of nozzles 411 may be disposed on a single long head so that the recording range extends over the total width of the medium M.

The liquid discharged or ejected by the liquid discharge section 41 is not limited to ink, and for example, may be a liquid material formed by dispersing or mixing particles of a functional material in a liquid, or the like. For example, the liquid discharge section 41 may be configured for recording by discharging a liquid material including a material, such as an electrode material, a color material (pixel material), or the like, which is used for manufacturing a liquid crystal display, an EL (electroluminescence) display, a surface-emitting display, and the like, in the form of dispersion or dissolution.

Also, as the above-described embodiment, it is possible to apply the liquid discharge apparatus to a printer supporting a sheet (medium M) of A3 size or less. However, it is also possible to apply the liquid discharge apparatus to a large format printer 11 that supports a sheet (medium M) of A2 size or more, for example as illustrated in FIG. 8, FIG. 9, FIG. 10, FIG. 11, and FIG. 12. Accordingly, for the large format printer 11 that performs printing on a sheet of large size, it is also possible to prevent deterioration of the print efficiency when a plurality of liquid discharge jobs are input.

This application claims priority under 35 U.S.C. §119 to Japanese Patent Application No. 2015-203050, filed Oct. 14, 2015. The entire disclosure of Japanese Patent Application No. 2015-203050 is hereby incorporated herein by reference.

What is claimed is:

1. A liquid discharge apparatus comprising:

a liquid discharge section including a nozzle configured to discharge liquid;

a cap configured to change an open space of the nozzle of the liquid discharge section to a closed space;

a liquid reception section configured to receive liquid discharged from the liquid discharge section; and a control section configured to discharge liquid from the liquid discharge section onto a medium on the basis of a first liquid discharge job including a liquid discharge condition, wherein when discharge of the liquid to the liquid reception section by the liquid discharge section is defined as flushing, and the cap forming the closed space is defined as capping, the control section causes;

the liquid to be discharged, performs a first flushing which is performed after discharge of the liquid based on the first liquid discharge job, and if a second liquid discharge job is not input while performing the first flushing, the control section causes the capping to be performed.

2. The liquid discharge apparatus according to claim 1, wherein a first elapsed time from completion of the discharge of the liquid based on the first liquid discharge job to completion of the capping when the first liquid discharge job is for forming an adjustment pattern on the medium to confirm a discharge result of the liquid is shorter than a second elapsed time when the first liquid discharge job is not for forming the adjustment pattern.

3. The liquid discharge apparatus according to claim 1, wherein if the first liquid discharge job is input while the capping is carried out, the control section causes a second flushing to be performed before discharge of the liquid based on the first liquid discharge job, and then discharges liquid on the basis of the first liquid discharge job, and an intensity of the first flushing is lower than an intensity of the second flushing.

4. The liquid discharge apparatus according to claim 1, further comprising:

a housing configured to accommodate the liquid discharge section; and a transport section configured to transport a medium having liquid discharged thereon by the liquid discharge section outside the housing, wherein when an area of the medium having liquid discharged thereon on the basis of the first liquid discharge job is defined as a discharged liquid area, the first flushing is performed until at least the discharged liquid area is transported outside the housing.

5. The liquid discharge apparatus according to claim 1, wherein a time which the first flushing is performed when the medium is long in a width direction of the medium is longer than that of when the medium is short in the width direction.

6. The liquid discharge apparatus according to claim 1, wherein if an elapsed time from completion of the discharge of the liquid based on the first liquid discharge job exceeds a waiting time, the control section determines that the second liquid discharge job is not input while performing the first flushing.

7. A method for performing flushing in a liquid discharge apparatus, the liquid discharge apparatus including a liquid discharge section including a nozzle configured to discharge liquid, a cap configured to change an open space of the nozzle of the liquid discharge section to a closed space, a liquid reception section configured to receive liquid discharged from the liquid discharge section, and a control section configured to discharge liquid from the liquid discharge section onto a medium on the basis of a first liquid discharge job including a liquid discharge condition, wherein when discharge of the liquid to the liquid reception section by the liquid discharge section is defined as flushing and the cap forming the closed space is defined as capping, the method comprising:

causing the liquid to be discharged based on a first liquid discharge job, performing a first flushing, which is performed after discharge of the liquid based on the first liquid discharge job, and if a second liquid discharge job is not input while performing the first flushing, causing the capping to be performed.

8. The method according to claim 7, wherein a first elapsed time from completion of the discharge of the liquid based on the first liquid discharge job to completion of the capping when the first liquid discharge job is for forming an adjustment pattern on the medium to confirm a discharge result of the liquid is shorter than a second elapsed time when the first liquid discharge job is not for forming the adjustment pattern.

9. The method according to claim 7, wherein, if the first liquid discharge job is input while the capping is carried out, a second flushing is performed before discharge of the liquid based on the first liquid discharge job, and then liquid is discharged on the basis of the first liquid discharge job, and an intensity of the first flushing is lower than an intensity of the second flushing.

10. The method according to claim 7, wherein the liquid discharge apparatus further includes a housing configured to accommodate the liquid discharge section, and a transport section configured to transport a medium having liquid discharged thereon by the liquid discharge section outside the housing, wherein when an area of the medium having liquid discharged thereon on the basis of the first liquid discharge job is defined as a discharged liquid area, the method further comprising:

performing the first flushing until at least the discharged liquid area is transported outside the housing.

11. The method according to claim 7, wherein a time which the first flushing is performed when the medium is long in a width direction of the medium is longer than that of when the medium is short in the width direction.

12. The method according to claim 7, wherein if an elapsed time from completion of the discharge of the liquid based on the first liquid discharge job exceeds a waiting time, determining that the second liquid discharge job is not input while performing the first flushing.

* * * * *